US005131461A

United States Patent [19]

Szucs

[11] Patent Number: 5,131,461

[45] Date of Patent: Jul. 21, 1992

[54] HEATING APPARATUS

[75] Inventor: Lajos Szucs, Rochester, N.Y.

[73] Assignee: Ronald Englert, Rochester, N.Y.

[21] Appl. No.: 675,440

[22] Filed: Mar. 26, 1991

[51] Int. Cl.[5] ..... F28F 13/14

[52] U.S. Cl. ..... 165/104.31; 165/122; 165/146; 392/357; 392/358; 392/496

[58] Field of Search ..... 165/122, 146, 104.31; 392/496, 357, 358, 359, 354

[56] References Cited

U.S. PATENT DOCUMENTS 1,524,520 1/1925 Junkers ..... 165/146
2,124,291 7/1938 Fleisher ..... 165/146
3,567,905 3/1971 Ferraro et al. ..... 392/358
4,165,783 8/1979 Oplatba ..... 165/146

*Primary Examiner*—Albert W. Davis, Jr.

[57] ABSTRACT

A heater which is preferably rated at about 1,500 watts is described. This heater contains at least three separate heat exchangers; each of the heat exchangers contains heat exchanger tubes, and each of the heat exchangers contains a different fluid capacity.

A blower passes cold air, in sequence, past the first heat exchanger, then past the second heat exchanger, and then past the third heat exchanger. At the same time, a pump forces a heated heat-exchange medium through the third heat exchanger, through the second heat exchanger, and then through the first heat exchanger.

20 Claims, 5 Drawing Sheets

FIG. 1
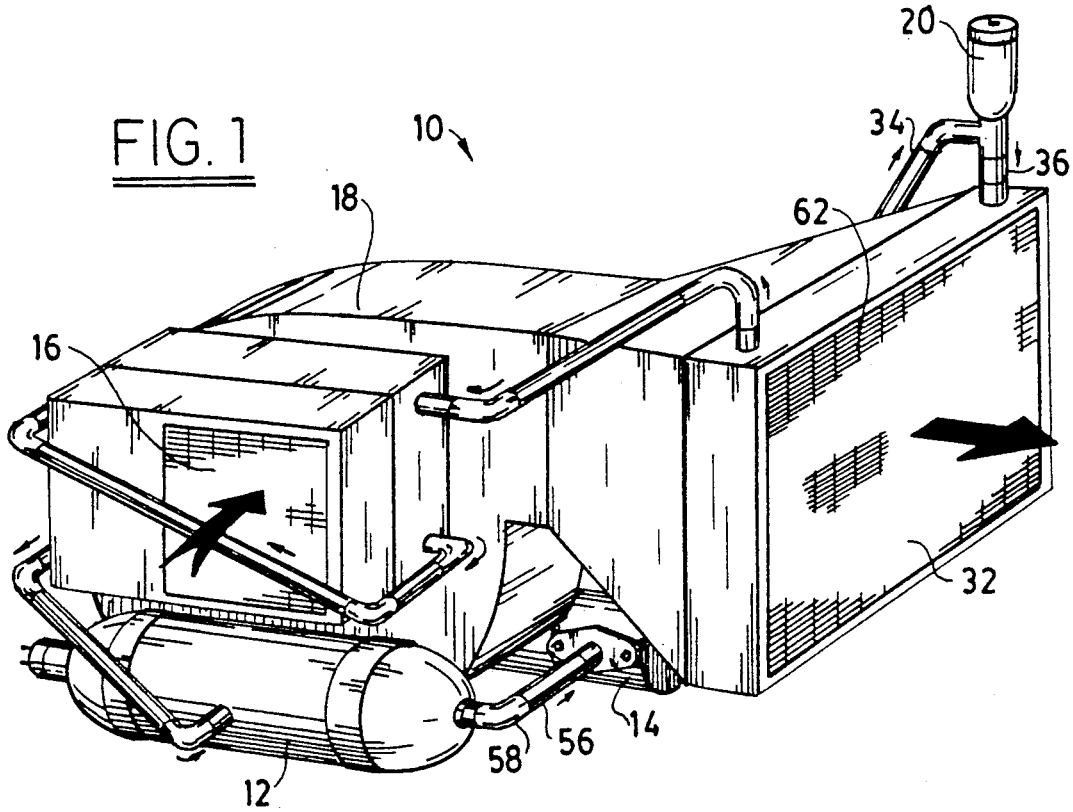
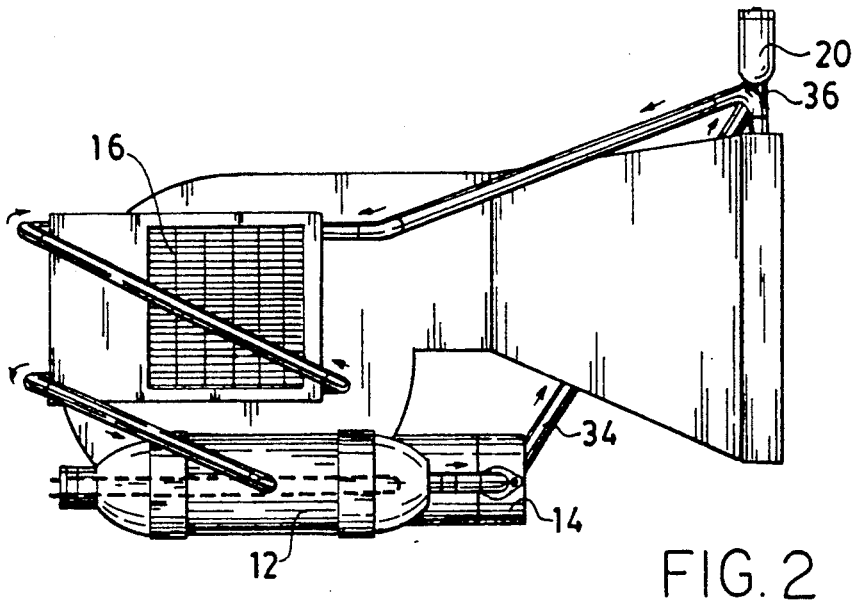
FIG. 2

HEATING APPARATUS

FIELD OF THE INVENTION

An improved heater which is contains at least three different heat exchange elements is disclosed.

BACKGROUND OF THE PRIOR ART

Heaters which are comprised of several heat exchange units are well known to the prior art. However, these heaters are usually complicated, inefficient, and expensive. Many of them generate noxious fumes, some of which are vented to the atmosphere.

It is an object of this invention to provide a heater whose operation does not create a substantial amount of pressure in the system.

It is another object of this invention to provide a heater which will not generate any fumes.

It is yet another object of this invention to provide a heater which is relatively safe, shielding the user from hot surfaces therein.

It is yet another object of this invention to provide a heater which is relatively efficient.

It is yet another object of this invention to provide a heater which is relatively inexpensive.

It is yet another object of this invention to provide a heater whose output can readily be varied.

SUMMARY OF THE INVENTION

In accordance with this invention, there is provided a heating apparatus. This apparatus contains a first heat exchanger, a second heat exchanger, a third heat exchanger, means for sequentially contacting air with said first, second, and third heat exchanger, and means for sequentially contacting heat exchange fluid with said third, second, and first heat exchanger.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 1 is a perspective view of one preferred embodiment of the apparatus of the invention;

FIGS. 2, 3, and 4 are left side, bottom, and right views, respectively, of the embodiment of FIG. 1;

DESCRIPTION OF THE PREFERRED EMBODIMENTS

Figure 3:
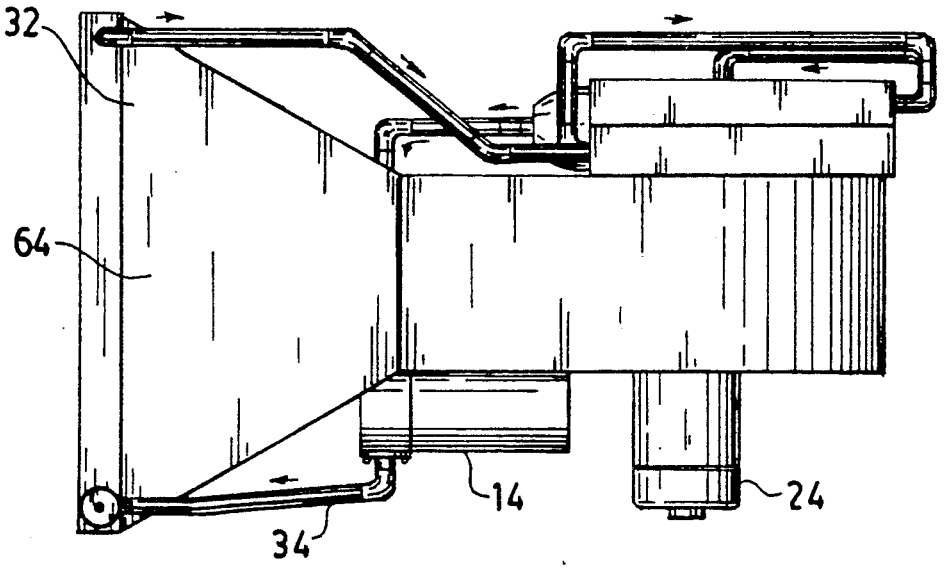

FIG. 1 is a perspective view of one preferred embodiment of the heater 10 of this invention. Referring to FIG. 1, it will be seen that heater 10 is comprised of a liquid heating chamber 12, a pump 14, air inlet 16, body 18, and pressure relief valve 20.

Figure 7:
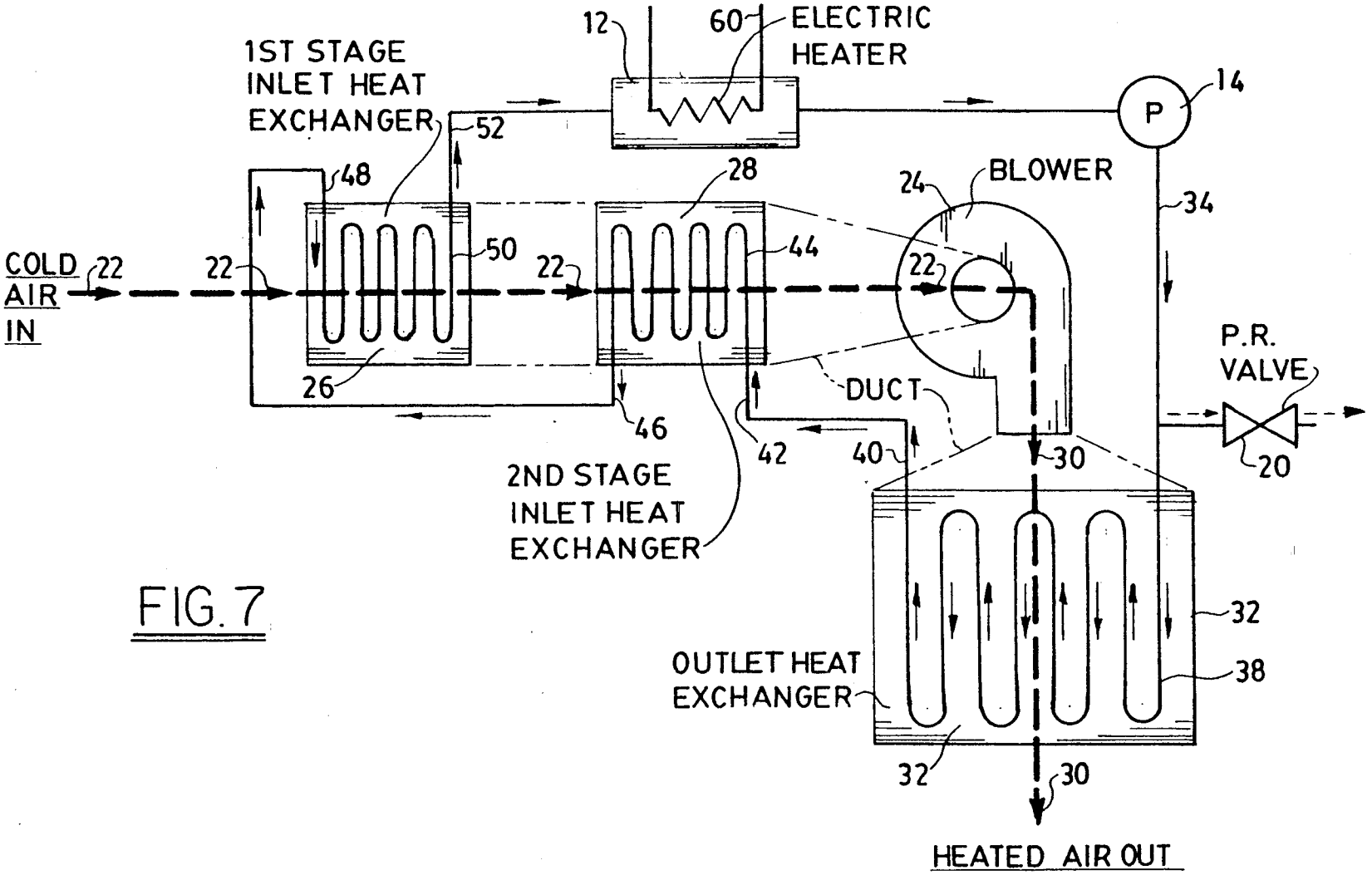
FIG. 7 is a flow chart of the process of the invention.

The operation of the heater 10 is schematically illustrated in FIG. 7, which is a flow chart of the invention.

Referring to FIG. 7, it will be seen that cold air is drawn in the direction of arrow 22 by blower 24. This cold air is first drawn through the first-state inlet heat exchanger 26 and the second stage inlet heat exchange

28. The air thus heated is then blown in the direction of arrows 30 through heat exchanger 32.

Any conventional blower may be used to draw cold air into the unit and exhaust it after it has been heated. Thus, by way of illustration and not limitation, one may use rotary blowers such as, e.g., a two-impeller type of rotary blower, a sliding vane type of rotary blower, a liquid piston type of rotary blower, and the like. These blowers are described on pages 6-24 and 6-25 of Robert H. Perry and Cecil H. Chilton's "Chemical Engineers' Handbook," Fifth Edition (McGraw-Hill Book Company, New York, 1973), the disclosure of which is hereby incorporated by reference into this specification.

By way of further illustration, one may use the blower described in U.S. Pat. No. 4,696,340 of Nagao et al., the disclosure of which is hereby incorporated by reference into this specification. Referring to the drawings of the Nagao patent, it will be seen that this blower is comprised of a blower casing 13 having an intake hole 11 and a discharge hole 12, a fan movably disposed in the blower casing 13, and a drive motor 14 mounted on the casing 13 and coupled with the fan. When the drive motor 14 is driven, air is drawn from the inner casing 3 through the outlet 4 and the intake hole 11 into the blower casing 13 and then is discharged from the discharge hole 12.

In one preferred embodiment, a forced air blower which is powered by a 110-volt or a 220-volt power supply may be used as blower 24. Thus, by way of illustration and not limitation, one may use blower model number 46447 (manufactured by the Dayton Company).

As indicated above, the cold air pulled into the heater 10 by blower 24 travels past a first stage inlet heat exchanger 26 and a second stage inlet heat exchanger 28.

Any means for transferring heat from one medium (such as a gas or a liquid) to air may be used as heat exchanger 26 and/or heat exchanger 28.

Any of the conventional heat exchangers may be used in the heater 10 of this invention. Thus, by way of illustration and not limitation, one may use the heat exchangers described on pages 11-3 to 11-26 of said "Chemical Engineers' Handbook," supra. Typical heat exchangers described in such pages include fixed tubesheet heat exchangers, U-tube heat exchangers, tank suction heaters, packed lantern ring exchangers, outside packed floating head exchangers, internal floating head exchangers, pull-through floating head exchangers, and the like.

Thus, by way of illustration, one may use the heat exchanger described in U.S. Pat. No. 4,169,500 of Braver, the disclosure of which is hereby incorporated by reference into this specification. The heat exchanger of this patent has a coil comprising a plurality of parallel, finned tubes connected to provide for the passage of a heat exchange fluid medium (see column 6 of the patent).

Thus, by way of illustration, one may use the heat exchanger described in U.S. Pat. No. 4,057,189 of Shoemaker, the disclosure of which is hereby incorporated by reference into this specification.

In one preferred embodiment, the heat exchanger(s) used is a heater core designed for use in an automobile radiator. These heater cores are well known to those skilled in the art and may be obtained from, e.g., the Harrison Radiator Company of Lockport, New York.

It is preferred that both heat exchanger 26 and heat exchanger 28 be comprised of heat-exchanger tubes. As is known to those skilled in the art, a heat exchanger tube is a tube for use in apparatus in which fluid inside the tube will be heated or cooled by fluid outside the tube. As used in this specification, the term heat exchanger tube applies to, e.g., coiled tube, tube which is commonly used in refrigerators, tube which is commonly used in radiators, and the like.

The heat-exchanger tube used in this invention may consist of any material conventionally used in heat-exchanger tubes. It is preferred, however, that such heat exchanger tube consist essentially of copper. In one preferred embodiment, such tube preferably has a substantially circular cross-sectional area and has an inner diameter of from about 0.5 to about 8.0 inches. In one aspect of this preferred embodiment, the internal diameter of such tube is from about 0.5 to about 2.0 inches and, in an even more preferred aspect, is about 0.75 inches.

It will be apparent to those skilled in the art that any tubing capable of withstanding the temperatures of the heated fluid also may be used in the heat exchanger(s). Thus, by way of illustration, one may use polyvinyl chloride (PVC) tubing, brass tubing, stainless steel tubing, and the like.

In one preferred embodiment, the heat exchanger used as the first stage inlet heat exchanger 26 and/or the second stage heat exchanger 28 and/or the third stage heat exchanger 32 has a substantially rectangular shape. Such a preferred heat exchanger preferably has a length of from about 4 to about 12 inches and, more preferably, from about 5 to about 11 inches. The height of the preferred heat exchanger is preferably from about 6 to about 10 inches and, more preferably, from about 7 to about 9 inches. The width of the heat exchanger is preferably from about 1 to about 5 inches and, more preferably, from about 1 to about 3 inches.

In one embodiment, the second stage heat exchanger 28 has larger fluid capacity than the first stage heat exchanger 26, being from about 1.1 to about 10 times as large in tube volume. In another embodiment, the third stage heat exchanger 32 has a larger fluid capacity than the second stage heat exchanger 28, being from about 1.1 to about 10 times as large in tube volume.

As used in this specification, the term fluid capacity refers to the volume defined by the tubing in each heat exchanger. As is known to those skilled in the art, the cross-sectional area of the tubing is equal to pi (3.1468) times the square of the internal radius of the tubing. The volume of tubing is equal to its length times its cross-sectional area; and this is the fluid capacity of the heat exchanger.

In one aspect, it is preferred that the fluid capacity of the second stage inlet heat exchanger 28 be from about 1.1 to about 3.0 times as large as the fluid capacity of the second stage heat exchanger 26 and, even more preferably, be about 1.3 to about 1.7 times as large. In this aspect, it is also preferred that the fluid capacity of the third stage inlet heat exchanger 32 be from about 1.1 to about 3.0 times as large as the fluid capacity of the second stage heat exchanger 28 and, even more preferably, be about 1.3 to about 1.7 times as large.

Referring again to FIG. 7, the heated air which passes through the second stage heat exchanger 28 also is forced by blower 24 through outlet heat exchanger 32. This outlet heat exchanger 32 is preferably, but not necessarily, similar in construction to heat exchangers 26 and 28.

It is preferred that heat exchange fluid be passed through the tubing of heat exchangers 26, 28, and 32 as air is being passed though the system in the opposite direction. Any of the heat-exchange fluids known to those skilled in the art may be used in the system.

By way of illustration and not limitation, one may use the heat transfer fluids described in U.S. Pat. No. 4,784,216 of Barcegirdle, the disclosure of which is hereby incorporated by reference into this specification. Thus, the primary heat transfer fluid may be a gas (such as super-heated steam). It is preferred, however, that the heat transfer fluid be a liquid, such a hot oil, commercially available synthetic heat transfer fluids, commercially available molten salt mixtures (such as a mixture of potassium nitrate, sodium nitrate, and sodium nitrate), solutions of calcium chloride, and the like.

Some other suitable heat transfer media are described in Chapter 7 of E. Stamper et al.'s "Handbook of Air Conditioning, Heating and Ventilating" (Industrial Press, Inc., 200 Madison Avenue, New York, N.Y., 10016, 1979), the disclosure of which is hereby incorporated by reference into this specification. As indicated in this publication, the heat transfer fluid may be water, glycerine, glycol, "AROCLOR" (a trade name describing a group of chlorinated biphenyls), "DOWTHERM" (a trademark for a group of liquid heat-transfer media sold by the Dow Chemical Company of Midland, Michigan), organic silicates (such as, e.g., aryl silicates and cresyl silicates), and the like.

Other heat exchange fluids are described on pages 9-41, 9-44 and 9-45 of said "Chemical Engineers' Handbook" ("DOWTHERM"), on pages 9-43 and 9-45 of said handbook (inorganic salts), on page 9-44 of said handbook (mercury), on pages 9-43 and 9-46 of said handbook (mineral oils), and pages 9-44 and 9-46 of said handbook ("THERMINOL"), and the like.

In one preferred embodiment, the heat transfer medium used is "PRESTONE" antifreeze, an ethylene glycol antifreeze sold by the First Brands Corporation of Danbury, Conn.

The heat exchange medium is pumped through applicant's heater system in a direction opposite to that of the air flow. Whereas the heat-exchange medium flows first to the third heat exchanger 32, and then to the second heat exchanger 28, and then to the first heat exchanger 26, the air flows first past the first heat exchanger 26, then past the second heat exchanger 28, and then past the third heat exchanger 32. Thus, in applicant's system, the heat exchange fluid and the air flow in opposite directions, i.e., they contact the heat exchangers in a different sequence.

The heat exchange fluid may be pumped through the system by any conventional pump means, such as, e.g., pump 14. Any conventional pump may be used as pump 14.

Referring to FIG. 2, it will be seen that pump 14 is comprised of an outlet 34 which communicates with the inlet 36 of the third heat exchanger 32 (not shown in FIG. 2). Referring to FIG. 7, it will be seen that the heat exchange fluid is then pumped through the coils 38 of heat exchanger 32 and, after exiting outlet 40 of heat exchanger 32, then enters heat exchanger 28 via inlet 42, to which it is connected in series. In like manner, the fluid passes through the coils 44 of heat exchanger 28, exits heat exchanger 28 through outlet 46, enters heat exchanger 26 through inlet 48, flows through the coils 50 of heat exchanger 26, exits heat exchanger 26 through outlet 52, and is then recycled through liquid heating chamber 12. Because the third heat exchanger 32 is connected in series to the second heat exchanger 28 which, in turn, is connected to the first heat exchanger 26, the third heat exchanger 32 will be at a higher temperature than the second heat exchanger 28 which, in turn, is at a higher temperature than the first heat exchanger 26. Thus, as the air is progressively drawn in through the system by blower 24, it will be progressively exposed to higher and higher temperatures.

By way of illustration, one may use the pumps in section 6 of the aforementioned "Chemical Engineers' Handbook," Fifth Edition.

By way of illustration and not limitation, one may use the cartridge circulators described in Catalog 100-1.1 of Taco, Inc., 1160 Cranston Street, Cranston, R.I. (published June, 1984). In this embodiment, one of the preferred Taco cartridge circulators is model number 005.

By way of further illustration, one may use the model UP15-42F "Hydronic Heating Circulator" sold by the Grundfos Pumps Corporation of 15555 Clovis Avenue, Clovis, Calif. This pump, which is described in Catalog UP-SL-003 (published Aug. 1, 1987), is specifically designed for closed, hydronic systems.

As will be readily apparent to those skilled in the art, other conventional pumps adapted for use with closed, hydronic systems also may be used as pump 14.

Referring again to FIG. 1, it will be seen that the inlet 56 of pump 14 is connected to the outlet 58 of liquid heating chamber 12.

Referring again to FIG. 7, it will be seen that liquid heating chamber 12 is comprised of a means 60 for heating fluid within chamber 12. As described above, this heated fluid is then passed through the third heat exchanger 32, then the second heat exchanger 28, and then the first heat exchanger 26.

Any conventional means may be used to heat the heat exchange fluid. Thus, in the embodiment illustrated in FIG. 7, an electric heater is used as heating means 60. Thus, e.g., one may use the heaters described in Section 11 of said Chemical Engineers' Handbook.

In one preferred embodiment, heating means 60 is a heating element of the immersion type which is described, e.g., on pages 37-38 of Catalog no. 22728F published by the A. O. Smith Corporation. This type of immersion heater is commonly used in the electric water heaters sold by A. O. Smith.

In one preferred embodiment, the heating means 60 heats the heat exchange fluid to a temperature of from about 80 to about 250 degrees Fahrenheit and, preferably, to a temperature of from about 140 to about 250 degrees Fahrenheit.

In one embodiment, not shown, heating means 60 is connected to a variable resistor (not shown) which, in turn, is connected to the source of power for the heating means. Thus, the heat output of heating means 60 may be adjusted by varying the resistor.

In another embodiment, not shown, the output of blower 24 and/or pump 14 is also varied by a similar means.

When an electric heater is used as heating means 60, it preferably will be connected to a source of direct or alternating current. It is preferred to use direct current and to connect said heating element to the source of direct current with a suitable wire such as, e.g., two-strand Romex cable.

In the preferred embodiment illustrated in FIG. 1, the outlet 32 from pump 14 is connected to a pressure relief valve 20. This valve is designed to vent to the atmosphere when the pressure in the system exceeds a certain specified maximum amount. Any of the pressure relief valves known to those skilled in the art may be used. Thus, by way of illustration, one may use the model EA 122 in-line automatic air vent sold by the Honeywell Company. Alternatively, one may use the water relief valves disclosed in catalog number F-TP-ASME 861 of the Watts Regulator Company, North Andover, Md.

Referring again to FIG. 1, the air drawn into the system passes through air inlet 16 and exits through grill 62 of the third heat exchanger 32.

FIG. 2 illustrates the flow of heated fluid from liquid heating chamber 12 to pump 14 to outlet 34 to the first heat exchanger 32 (not shown).

Figure 4:
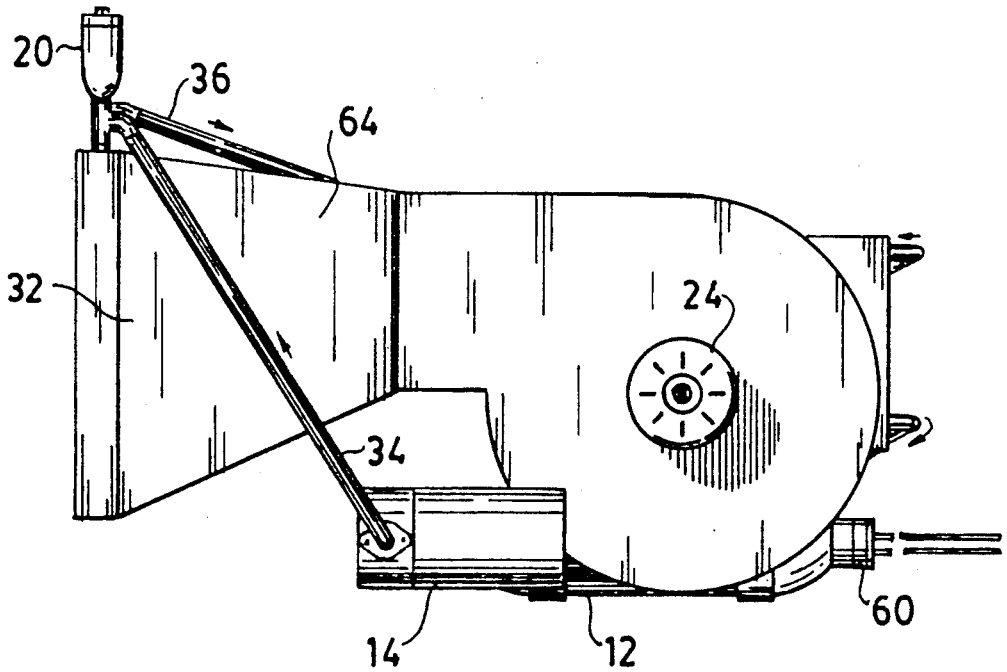

FIGS. 3 and 4 illustrate the preferred embodiment of FIG. 1. Referring to FIG. 3, it will be seen that the third heat exchanger 32 of heater 10 is preferably enclosed by a hood 64. This hood 64 may be made by any conventional means. Thus, in one embodiment, it is made from standard galvanized steel. In another embodiment, it is made from plastic, wood, reinforced cardboard, or any other product capable of holding heat.

Figure 5:
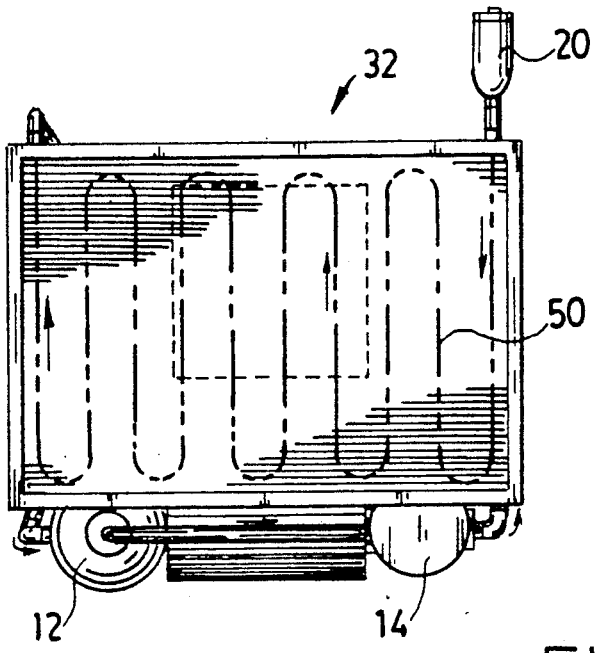
FIGS. 5 and 6 are front and back sectional views, respectively, of the apparatus of FIG. 1.
Figure 6:
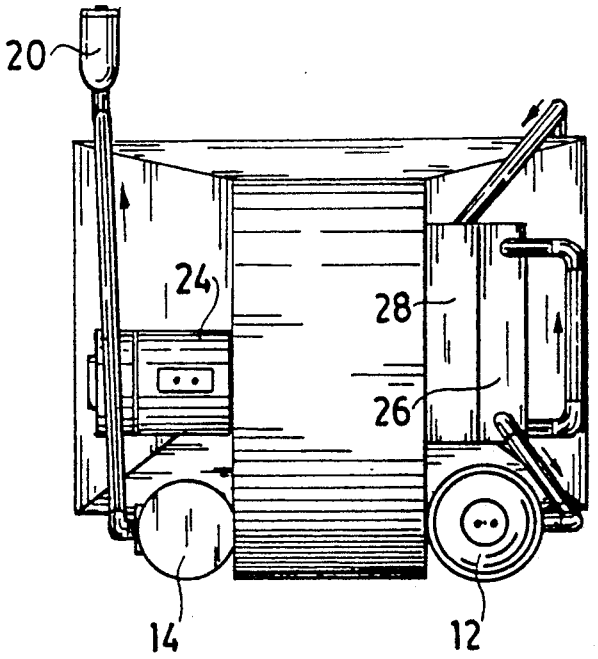

FIGS. 5 and 6 are cross-sectional view the preferred heater 10. FIG. 5 is a front sectional view, showing heat exchanger 32 in cross section. FIG. 6 is a back view, showing heat exchangers 28 and 26.

Figure 9:
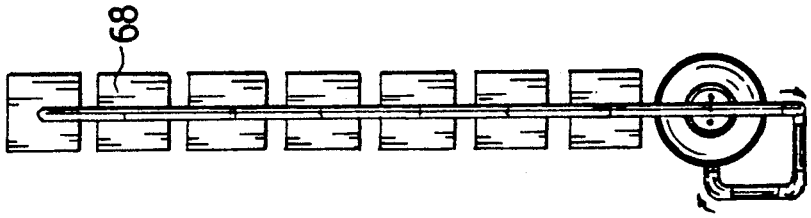
FIGS. 8 and 9 are partial view of the tubing used in one embodiment of the apparatus of the invention.
Figure 8:
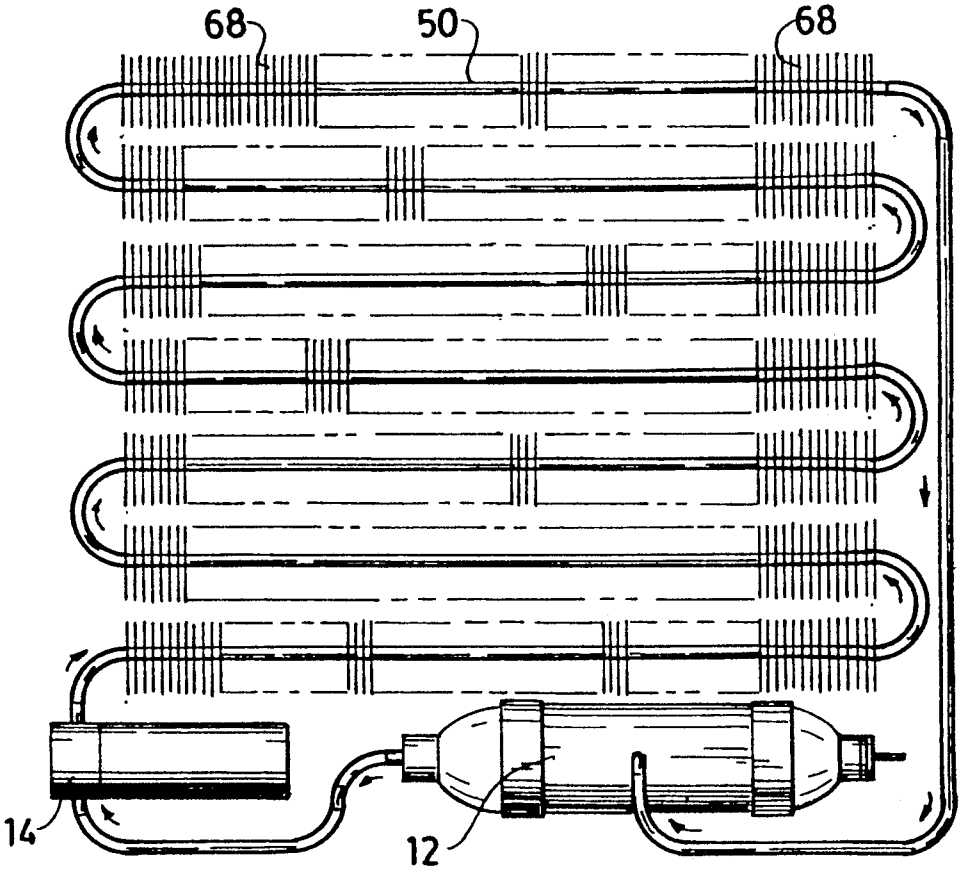

FIGS. 8 and 9 illustrate one preferred embodiment of the invention in which some or all of the tubing in one or more of the heat exchangers is comprised of heat conductive radiation fins 68. As is well known to those skilled in the art, one may purchase tubing comprised of these radiation fins. Thus, by way of illustration and not limitation, one may purchase heat-conducting finned radiation tubing from the Argo Industries, Inc. of Berlin, Conn. as "low-trim baseboard."

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A heating apparatus comprises of:

(a) a first heat exchanger, a second heat exchanger, and a third heat exchanger, wherein:

1. each of said first heat exchanger, said second heat exchanger, and said third heat exchanger is comprised of heat exchanger tubes,
2. said heat exchanger tubes in said third heat exchanger have a fluid capacity which is from about 1.1 to about 10 times as large as the fluid capacity of the heat exchanger tubes in said second heat exchanger,
3. said heat exchanger tubes in said second heat exchanger have a fluid capacity which is from about 1.1 to about 10 times as large as the fluid capacity of the heat exchanger tubes in said first heat exchanger, and
4. said first heat exchanger, said second heat exchanger, and said third exchanger are connected in series;

(b) means for sequentially contacting air with said first heat exchanger, said second heat exchanger, and said third heat exchanger, provided that said air is first contacted with said first heat exchanger;

(c) means for providing a heated fluid at a temperature of from about 80 to about 250 degrees Fahrenheit, wherein said fluid is selected from the group consisting of gas, liquid, and mixtures thereof; and (d) means for sequentially passing said heated fluid through said heat exchange tubes of said third heat exchanger, said second heat exchanger, and said first heat exchanger, wherein said heated fluid is first passed through the heat exchanger tubes of said third heat exchanger.

2. The heating apparatus as recited in claim 1, wherein said fluid is liquid.

3. The heating apparatus as recited in claim 2, wherein said means for sequentially contacting air with said first heat exchanger, said second heat exchanger, and said third heat exchanger is comprised of a blower.

4. The heating apparatus as recited in claim 3, wherein said heat exchanger tubes consist essentially of copper.

5. The heating apparatus as recited in claim 4, wherein said liquid is comprised of ethylene glycol.

6. The heating apparatus as recited in claim 4, wherein said apparatus is comprised of means for heating said liquid to a temperature of from about 140 to about 250 degrees Fahrenheit.

7. The heating apparatus as recited in claim 6, wherein said means for heating said liquid to a temperature of from about 140 to about 250 degrees Fahrenheit is comprised of an electric heater.

8. The heating apparatus as recited in claim 1, wherein said heat exchanger tubes consist essentially of copper.

9. The heating apparatus as recited in claim 1, wherein said liquid is comprised of ethylene glycol.

10. The heating apparatus as recited in claim 1, wherein said apparatus is comprised of means for heating said liquid to a to a temperature of from about 140 to about 250 degrees Fahrenheit.

11. The heating apparatus as recited in claim 1, wherein said means for heating said liquid to a temperature of from about 140 to about 250 degrees Fahrenheit is comprised of an electric heater.

12. The heating apparatus as recited in claim 11, wherein said electric heater is comprised of means of varying the heat output of said heater.

13. The heating apparatus as recited in claim 1, wherein said third heat exchanger is enclosed by a hood.

14. The heating apparatus as recited in claim 1, wherein said heat exchanger tubes are heat-conducting finned radiation tubes.

15. The heating apparatus as recited in claim 1, wherein said means for passing said heated fluid through said heat exchange tubes is comprised of a pump.

16. The heating apparatus as recited in claim 15, wherein said heating apparatus is comprised of means for passing said heated fluid through said heat exchange tubes at a rate of from about 2 to about 6 gallons per minute.

17. The heating apparatus as recited in claim 16, wherein said heating apparatus is comprised of means for passing said heated fluid through said heat exchange tubes at a rate of from about 3 to about 5 gallons per minute.

18. The heating apparatus as recited in claim 17, wherein said heating apparatus is comprised of means for sequentially passing air past said first heat exchanger, said second heat exchanger, and said third heat exchanger at a rate of from about 1.5 to about 2 cubic feet per minute.

19. The heating apparatus as recited in claim 1, wherein said heating apparatus is comprised of means for sequentially passing air past said first heat exchanger, said second heat exchanger, and said third heat exchanger at a rate of from about 1 to about 5 cubic feet per minute.

20. The heating apparatus as recited in claim 1, wherein said heating apparatus is comprised of means for sequentially passing air past said first heat exchanger, said second heat exchanger, and said third heat exchanger at a rate of from about 1 to about 3 cubic feet per minute.

* * * * *